US005485786A

United States Patent [19]

Hesse et al.

[11] Patent Number: 5,485,786

[45] Date of Patent: Jan. 23, 1996

[54] ELECTRONIC PRIMER IGNITION SYSTEM

[75] Inventors: Philip W. Hesse, Ellicott City; Raymond Goetz, Baltimore; Daniel Lenko, Monrovie, all of Md.

[73] Assignee: The United States of America as represented by the Secretary of the Navy, Washington, D.C.

[21] Appl. No.: 433,858

[22] Filed: May 2, 1995

Related U.S. Application Data

[63] Continuation of Ser. No. 151,695, Nov. 15, 1993.

[51] Int. Cl.[6] ..... F41A 19/58; F42B 5/08

[52] U.S. Cl. ..... 102/202.5; 102/472; 89/28.05; 42/84

[58] Field of Search ..... 42/84, 41, 46; 340/577; 89/135, 136, 28.05, 28.1; 102/472, 202.5, 207

[56] References Cited

U.S. PATENT DOCUMENTS 3,650,174 3/1972 Nelsen ..... 42/41

3,844,216 10/1974 Jakobs et al. ..... 102/46

4,357,602 11/1982 Lemelson ..... 340/577

5,303,495 4/1994 Harthcock ..... 42/84

*Primary Examiner*—Daniel T. Pihulic

*Attorney, Agent, or Firm*—Jacob Shuster

[57] ABSTRACT

Ignition current is conducted by a firing circuit through a firing pin to a primer mixture retained by its cap within a cartridge case from which the cap is electrically separated by an insulator to effect primer ignition with reduced lock time by activation of a firing switch independently of the firing pin. Voltage for the firing circuit is derived from a battery, maintained in a charged condition by alternate voltage supply sources, and stored at an ignition firing level for a prolonged period of time to accommodate selective activation of the firing switch after the firing pin contacts the primer cap.

11 Claims, 1 Drawing Sheet

ELECTRONIC PRIMER IGNITION SYSTEM

This application is a continuation of pending application Ser. No. 08/151,695 filed Nov. 15, 1993.

This invention relates generally to the ignition of an explosive charge through a primer mixture that is electrically ignited.

BACKGROUND OF THE INVENTION

The ignition of primer mixtures associated with ordnance such as ammunition cartridges by electrical means, is generally well known in the art as disclosed for example in U.S. Pat. Nos. 3,090,310, 3,413,888, 4,332,098 and 4,386,567 to Peet et al., Kaley, Estenevy and Ciccone et al., respectively. The Peet et al. and Ciccone et al. patents furthermore disclose the protective enclosure of a primer retention cup by an insulating liner within a cartridge case. The Estenevy patent, on the other hand, features battery operated electrical circuitry through which a trigger current is supplied to the primer from a power relay thyristor upon closing of a trigger switch connected to a voltage storing capacitor charged by the battery through a dc pulsating voltage converter.

While the relevant teachings of the foregoing referred to prior art patents are allegedly designed to improve firing accuracy, such teachings do not deal with the problems arising during the interval between release of the movable firing pin or hammer in response to a firing command and the instant that such firing pin strikes or contacts the primer. During such intervals, referred to as lock time, vibrations are generated by movement of the firing pin to introduce firing inaccuracies. Thus, firing accuracy for rifles may be improved by increasing firing pin speed to reduce lock time. Increase in speed of the firing pin is however limited by the degree to which its weight may be reduced and/or the extent to which the strength of the drive spring for the firing pin may be increased.

It is therefore an important object of the present invention to improve firing accuracy of ordnance with an electrically activated primer having a mechanically displaced firing pin, by substantially reducing the lock time interval beyond the capacity available through reduction in weight of the firing pin and/or increase in its drive spring strength.

SUMMARY OF THE INVENTION

In accordance with the present invention, the motion of a firing pin toward a primer and activation of an arming switch is completed before a firing command is transmitted to an electronic relay in a firing circuit supply ignition current to the primer through the firing pin and a primer retention cap. The primer is an electrically conductive type of explosive mixture retained by its cap within a cartridge case also made of an electrically conductive material to which the firing circuit is connected. The ignition current is conducted through the relay of the firing circuit selectively controlled by a trigger switch generating the firing command so that lock time between activation of the trigger switch and displacement of the firing pin into contact with the primer cap externally of the cartridge case is reduced to zero. Flow of ignition current from the firing pin is restricted to the primer mixture by means of an insulator electrically separating the primer cap from the primer mixture enclosed within the cartridge case in spaced relation to an explosive charge.

The aforementioned ignition current is derived from a battery maintained at an ignition voltage level condition by a charging circuit optionally connected to either a piezoelectric or solar energy voltage source through a selector switch to prolong supply of a uniform dc pulsating voltage to the firing circuit from which the ignition voltage level is sustained.

BRIEF DESCRIPTION OF DRAWING FIGURES

A more complete appreciation of the invention and many of its attendant advantages will be readily appreciated as the same becomes better understood by reference to the following detailed description when considered in connection with the accompanying drawing, wherein:

FIG. 1 is a partial side section view of a cartridge case and circuit diagram of an associated electrical firing system in accordance with one embodiment of the invention; and FIG. 2 is a more detailed circuit diagram of the pulse current supply component of the system diagrammed in FIG. 1.

DETAILED DESCRIPTION OF PREFERRED EMBODIMENT

Figure 1:
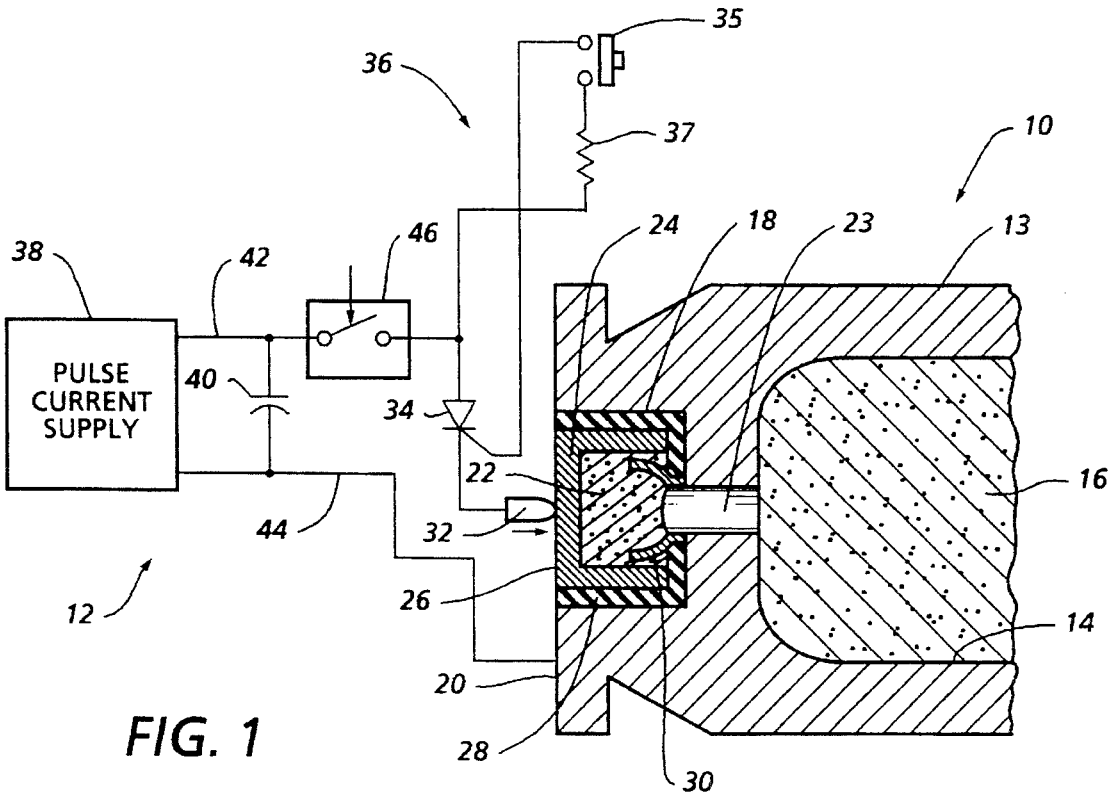

Referring now to the drawing in detail, FIG. 1 illustrates the base end portion of an ordnance cartridge case, generally referred to by reference numeral 10. An electronic firing system, generally designated by reference numeral 12, is associated with the cartridge case 10 as also depicted in FIG. 1.

The body 13 of the cartridge case 10 is made of an electrically conductive material and has a cavity 14 therein forming an enclosure for an explosive propellant charge 16 in the illustrated embodiment. A pocket 18 is also formed in the cartridge case, opening rearwardly from its base end 20, to enclose an electrically conductive primer mixture 22, such as Styphnate. The primer enclosing pocket 18 is spaced from the cavity 14 containing the explosive charge 16, but is in communication therewith through a passage 23 as shown in FIG. 1.

In accordance with the present invention, the primer mixture 22 is retained within the pocket 18 of the cartridge case by an electrically conductive retention cap 24 having an external end surface 26 in planar alignment with the base end 20 of the cartridge case, within which the cap is received. The pocket 18 is lined with an imperforate insulator 28, as shown in FIG. 1 electrically separating the cap 24 from the cartridge case so as to insure that electrical ignition current will be conducted completely through the primer mixture 22 when ignition voltage is applied, as hereinafter pointed out. An electrically conductive insert 30 therefore establishes electrical contact between the cartridge case and the primer mixture 22, as shown in FIG. 1, at the inner axial end of pocket 18 opposite the axial end at which the ignition current is supplied through cap 24.

Ignition current is supplied to cap 24 through a firing pin 32 which is mechanically displaceable into contact with cap end 26 externally of the cartridge case as shown in FIG. 1. The firing pin 32 is connected electrically to an output electrode of an electronic power relay, such as thyristor 34 in a triggering circuit 36 of the electronic firing system 12 as diagrammed in FIG. 1. The thyristor 34 also includes a control electrode connected to a trigger switch 35 in series with resistor 37. The firing circuit 36 also includes a capacitor 40 within which voltage from a pulse current supply 38 is stored for application to the input electrode of the power relay thyristor 34 so as to supply ignition triggering current to the firing pin 32 from which it is conducted through cap 24 to the primer mixture 22. A uniform pulsating DC voltage is therefore applied through voltage line 42 from supply 38 to one side of the capacitor 40, which is thereby maintained in a fully charged state. The other side of the capacitor 40 is connected to the supply 38 and the cartridge case 10 through a return line 44 to complete the firing circuit.

With continued reference to FIG. 1, an arming switch 46 is shown connecting the voltage line 42 to resistor 37 and the input electrode of the power relay thyristor 34 to control primer ignition with reduced lock time. Thus, the trigger voltage stored in capacitor 40 is applied across thyristor 34 by closing of the arming switch 46 to initiate primer ignition after displacement of the firing pin 32 into contact with cap 24. Any suitable type of arming switch 46 may be utilized for such purpose, such as a microswitch or an optical interrupt type of switch activated by bolt action of a rifle, or some other action independent of subsequent manually controlled activation of trigger switch 35 in response to a finger pressure firing command applied to a rifle trigger for example. Ignition triggering current will accordingly be delivered, as a result of a firing decision, to the firing pin 32 after it contacts the cap 24 thereby effecting primer ignition with zero lock time to avoid the effect of vibrations generated during motion of the firing pin.

Figure 2:
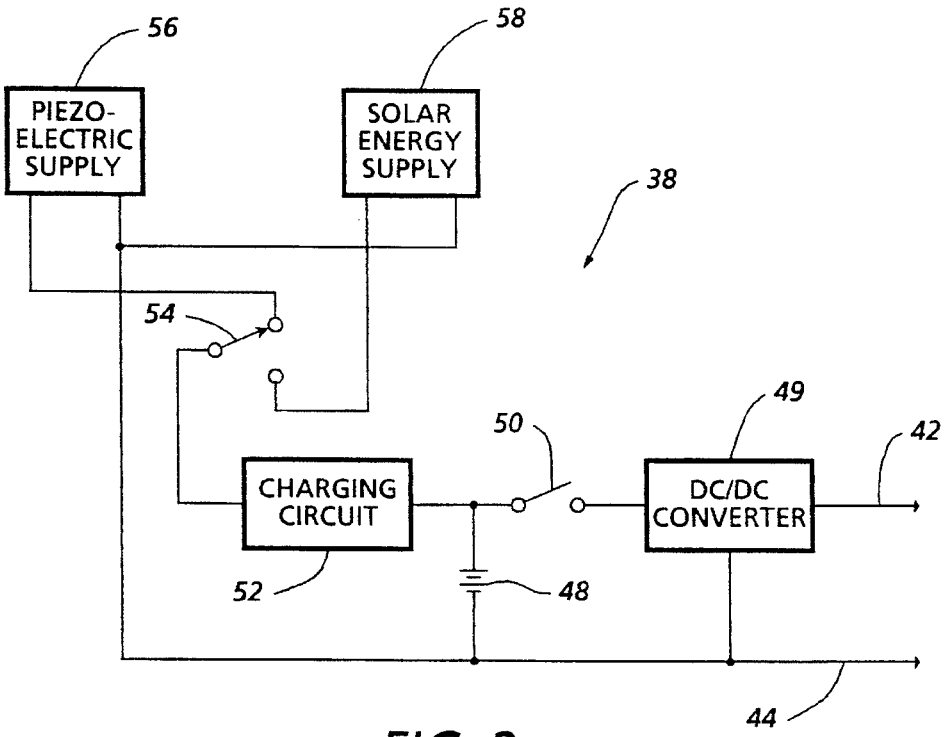

The capacity of the pulse current source 38 to provide uniform pulsating dc voltage to the firing circuit 36 for a period of time to accommodate formulation of a firing decision, is made possible by an arrangement as diagrammed in FIG. 2. The supply of voltage of sufficient magnitude made available for achieving primer ignition, as hereinbefore described, is thereby prolonged in accordance with the present invention. As shown, the uniform pulsating voltage applied through line 42 is derived from a dc battery 48 through a converter 49 after closing of an ignition enabling safety switch 50. The converter 49, operative to transform the dc voltage from battery 48 into the uniform pulsating dc voltage in line 42, is of a type well known in the art as disclosed for example in U.S. Pat. No. 4,332,098 to Estenevy, aforementioned.

The battery 48 is maintained in a sufficiently charged condition through a charging circuit 52 of any suitable type well known in the art, connected alternatively to plural voltage sources through a selector switch 54. In the embodiment diagrammed in FIG. 2, such voltage sources consist of a piezoelectric type of voltage supply 56 and a solar energy accumulating voltage supply 58. Such voltage supplies 56 and 58 are respectively well known in the art, the details of which per se form no part of the present invention. Thus, either one of such voltage supplies 56 and 58 may be selected at the option of the electronic firing system operator to maintain the battery 46 charged, in accordance with the present invention.

Obviously, numerous other modifications and variations of the present invention are possible in light of the foregoing teachings. It is therefore to be understood that within the scope of the appended claims the invention may be practiced otherwise than as specifically described.

What is claimed is:

1. In combination with a cartridge case within which a primer mixture is retained by a retention cap and means for ignition of the primer mixture including a firing pin and triggering circuit means for transmission of electrical ignition current to the firing pin and a voltage supply battery, the improvement residing in: converter means connecting the battery to the triggering circuit means for supply thereto of uniform pulsating voltage from which the ignition current is derived and voltage charging means connected to the battery for prolonging said supply of the uniform voltage to the triggering circuit means to continue said transmission of the electrical ignition current to the firing pin following displacement thereof into contact with the retention cap.

2. The combination as defined in claim 1 wherein said voltage charging means comprises: a piezoelectric power supply, a solar energy power supply; a charging circuit connected to the battery; and selective switch means for alternatively connecting the piezoelectric and solar energy power supplies to the charging circuit to maintain the battery fully charged.

3. The combination as defined in claim 2 wherein said triggering circuit means includes a storage capacitor maintained charged by said uniform pulsating voltage, electronic relay means connected to the firing pin for controlling supply of said electrical ignition current thereto from the storage capacitor and trigger switch means connected to the electronic relay means for selectively initiating said supply of the electrical ignition current to the firing pin.

4. The combination as defined in claim 1 wherein said triggering circuit means includes a storage capacitor maintained charged by said uniform pulsating voltage, power relay means connected to the firing pin for supply of said electrical ignition current thereto in response to trigger voltage from the storage capacitor and switch means connected to said power relay means for selectively controlling said supply of the electrical ignition current to the firing pin.

5. In combination with an electrically conductive ordnance enclosure having a pocket formed therein within which a primer is retained, a firing pin and electronic means conducting electrical current through the primer for ignition thereof in response to a firing command, including triggering circuit means for supply of said electrical current to the primer through the firing pin following displacement thereof into electrical contact with the primer and switch means connected to the triggering circuit means for generating said firing command and reducing to zero ignition lock time between the firing command and said ignition of the primer after said contact of the firing pin with the primer.

6. The combination as defined in claim 5 wherein said triggering circuit means includes a storage capacitor maintained charged by uniform pulsating voltage, and relay means connected to the switch means and the firing pin for controlling said supply of the electrical current to the firing pin from the storage capacitor under charge.

7. The combination as defined in claim 6 wherein the electronic means further includes a voltage supply battery, converter means connecting the battery to the triggering circuit means for supply thereto of said uniform pulsating voltage and voltage charging means connected to the battery for prolonging said supply of the uniform pulsating voltage to the storage capacitor of the triggering circuit means to continue said supply of the electrical current to the firing pin after said contact thereof with the primer.

8. The combination as defined in claim 7 wherein said voltage charging means comprises a piezoelectric power supply, a solar energy power supply, a charging circuit connected to the battery and selective switch means for alternatively connecting the piezoelectric and solar energy power supplies to the charging circuit to maintain the battery fully charged.

9. In combination with an electrically conductive cartridge case having a pocket within which an electrically conductive primer mixture is retained by an electrically conductive cap; firing circuit means electrically connected to the cartridge case for supplying electrical ignition current to the primer mixture through the cap in response to a firing command; insulating means internally lining the pocket in contact with the cartridge case to electrically separate the primer mixture and the retention cap therefrom for limiting said electrical ignition current to flow from the cap through the primer mixture; and trigger switch means connected to the firing circuit means for generating said firing command to effect ignition of the primer mixture by the ignition current with zero lock time.

10. The combination as defined in claim 9 including a firing pin displaced into contact with the cap externally of the cartridge case, said firing circuit means comprising: a battery from which an ignition voltage is derived, power relay means operatively connected to said battery and the trigger switch means for conducting the electrical ignition current to the firing pin, from the battery under said ignition voltage in response to said firing command after said contact of the firing pin with the cap and storage means connected to the battery for prolonging said ignition voltage thereof following said displacement of the firing pin to accommodate said ignition in response to said firing command.

11. The combination as defined in claim 9, including an electrically conductive insert extending from the primer mixture within the pocket into contact with the cartridge case in spaced relation to the retention cap.

* * * * *